United States Patent [19]

Knaebel

[11] Patent Number: 4,573,321

[45] Date of Patent: Mar. 4, 1986

[54] POWER GENERATING CYCLE

[75] Inventor: Kent S. Knaebel, Dublin, Ohio

[73] Assignee: EcoEnergy I, Ltd., Columbus, Ohio

[21] Appl. No.: 668,755

[22] Filed: Nov. 6, 1984

[51] Int. Cl.[4] ..... F01K 25/06

[52] U.S. Cl. ..... 60/649; 60/655; 60/673

[58] Field of Search ..... 60/649, 653, 655, 673, 60/679, 689

[56] References Cited

U.S. PATENT DOCUMENTS

| | | | |
|---|---|---|---|
| 427,401 | 5/1890 | Campbell | 60/673 |
| 1,687,941 | 10/1928 | Koenemann | 60/649 |
| 1,961,788 | 6/1934 | Roe | 60/673 |
| 3,505,810 | 4/1970 | Mamiya | 60/673 |
| 3,783,613 | 1/1974 | Billings et al. | 60/626 |
| 4,009,575 | 3/1977 | Hartman, Jr. et al. | 60/648 |
| 4,195,485 | 4/1980 | Brinkerhoff | 60/649 |
| 4,292,808 | 10/1981 | Lohmiller | 60/673 |
| 4,295,335 | 10/1981 | Brinkerhoff | 60/673 |
| 4,333,313 | 6/1982 | Cardone et al. | 60/649 |
| 4,346,561 | 8/1982 | Kalina | 60/673 |

OTHER PUBLICATIONS

Kalina, "Combined Cycle System with Novel Bottoming Cycle", *Transactions of the ASME,* ASME Paper 84-GT-173, Jun. 1984.

Nagib, "Analysis of a Combined Gas Turbine and Absorption-Refrigeration Cycle", *Journal of Engineering for Power,* pp. 28-32, Jan. 1971.

Nimmo et al., "A Novel Absorption Regeneration--Thermodynamic Heat Engine Cycle", *Journal of Engineering for Power,* pp. 566-570, Oct. 1978.

*Primary Examiner*—Stephen F. Husar

*Attorney, Agent, or Firm*—Mueller and Smith

[57] ABSTRACT

The present invention is a multi-step process for generating energy from a source heat flow. Such a process comprises passing a heated media having a mixture of a low volatility component and a high volatility component into a phase separator. The vaporous working fluid is withdrawn from the phase separator and passed into a work zone, such as a turbine, wherein the fluid is expanded. The expanded vaporous working fluid is withdrawn from the work zone and passed into a direct contact condenser or absorber. The separated weak solution is withdrawn from the phase separator and passed into counter-current heat exchange relationship in an interchanger with a portion of media from the direct contact condenser or absorber. The media from the direct contact condenser or absorber is withdrawn and passed into a fluid pressurizing zone. A portion of the media is then pumped into the interchanger where the media is heated and passed into counter-current heat exchange relationship in a trim heater with a portion of the source heat flow. The remaining portion of the media from the fluid pressurizing zone is pumped into counter-current heat exchange relationship in a regenerator with the remaining portion of the source heat flow. The heated media flows from the trim heater and the regenerator are combined to form the heated media and the cycle repeated.

17 Claims, 3 Drawing Figures

POWER GENERATING CYCLE

BACKGROUND OF THE INVENTION

The present invention relates to the extraction of energy from a heat source by means of a working fluid which is regenerated in the cycle, and more particularly to a power generating cycle which permits the extraction of energy from low temperature heat sources.

Generation of energy by expansion of a working fluid is limited by the temperatures at which heating and cooling sinks economically can be used in the regeneration of the working fluid. Pure or azeotropic (subcritical) working fluids condense and boil at essentially constant temperatures which further limits the power generating cycle, especially the ability of the cycle to utilize low temperature heat sources. In an effort to overcome such deficiencies, attempts at combining absorption/refrigeration principles in the power generating cycle have been proposed. Such proposals additionally utilize a dissolved working fluid in a solvent so that the working vapor condenses over a range of temperatures and boils from the media (working fluid plus solvent) over a range of temperatures. Such binary working fluid pair permits extraction of energy from a source and rejection to a sink over a wider temperature range than cycles that merely employ pure or azeotropic working fluids.

Representative proposals on this subject include Nimmo et al., "A Novel Absorption Regeneration-Thermodynamic Heat Engine Cycle", *Journal of Engineering for Power,* Vol. 100, pp 566–570, The American Society of Mechanical Engineers (October 1978) and U.S. Pat. No. 4,009,575 which propose to use potassium carbonate as the solvent and carbon dioxide as the working fluid in the power generating cycle. Such binary pair is heated by a heat source which vaporizes the carbon dioxide therefrom. The working vapor passes through a superheater, and thence to the turbine whereat its temperature and pressure are lowered for performing useful work. The turbine exhaust then goes to a direct contact absorber. The weak solvent solution from the vaporizer is passed to an intermediate heat exchanger, thence to a cooler, and finally into the direction contact absorber for chemically combining with the spent working vapor. The reconstituted binary solution then is pumped to the heat exchanger to heat exchange with the weak solution of potassium carbonate and thence to the vaporizer. Another proposal is that found in U.S. Pat. No. 4,346,561 which proposes the use of a binary ammonia/water pair. The power cycle claimed utilizes a plurality of regeneration stages wherein the working vapor is condensed in a solvent, pressurized, and evaporated by heating. The evaporated working vapor then passes to a next successive regeneration stage while the separated weak solution is passed back to the preceding regeneration stage. Interestingly, the cycle in FIG. 4 of this patent appears coincidental with the cycle discussed in the Nimmo et al. ASME publication, cited above. Yet another proposal is that of Nagib, "Analysis of a Combined Gas Turbine and Absorption-Refrigeration Cycle", *Journal of Engineering or Power,* pp 28–32, The American Society of mechanical Engineers (Jan. 1971) which proposes to utilize the exhaust gases from a gas turbine to operate a refrigeration unit. The refrigeration unit is used to cool the air prior to its entering the compressor. The reduction in compressor-inlet temperature is stated to result in an improvement in thermal efficiency of the combined cycle as well as an increase in the specific output.

While such proposals and others have been a step forward in the power generating field, much room for improvement exists.

BROAD STATEMENT OF THE INVENTION

The present invention is a multi-step process for generating energy from a source heat flow. Such process comprises passing a heated media comprising a mixture of a low volatility component and a high volatility component into a phase separator. The media is at a temperature and pressure adequate for the more volatile working fluid to be vaporized and separated from the remaining solution in the phase separator. The working fluid is characterized by boiling from said solution over a range of temperatures, and by direct contact condensing (or absorption) in said solution over a range of temperatures. The vapor pressure of the less volatile component over said boiling point range is very small so that essentially none is volatilized and separated in said phase separator. The vaporous working fluid is withdrawn from the phase separator and passed into a work zone, such as a turbine, wherein the fluid is expanded to a lower pressure and temperature to release energy. The expanded vaporous working fluid is withdrawn from the work zone and passed into a direct contact condenser or absorber. The separated weak solution (i.e. depleted in its more volatile component and enriched in its less volatile component) is withdrawn from the phase separator and passed into counter-current heat-exchange relationship in an interchanger with a portion of media from said direct contact condenser. The heat-exchanged weak solution is withdrawn from the interchanger and passed into said direct contact condenser wherein it is contacted with the expanded vaporous working fluid for absorbing said working fluid into said weak solvent solution for forming said media. A coolant flow is passed into the direct contact condenser for absorbing heat from the contents therein. The cooled media is withdrawn from the direct contact condenser and passed into a fluid energy transport or pressurizing zone (e.g. a pump). A portion of the media then is pumped into said interchanger to establish said counter-current heat-exchange relationship with said separated weak solvent solution therein. The heated media withdrawn from the interchanger then is passed into counter-current heat-exchange relationship in a trim heater with a portion of said source heat flow. The remaining portion of the media from the fluid energy transport zone is pumped into counter-current heat-exchange relationship in a regenerator with the remaining portion of the source heat flow. The heated media flows from the trim heater and the regenerator are combined to form said heated media and the cycle repeated.

In an alternative embodiment wherein a relatively high temperature heat source is available, the power generating cycle comprises a topping cycle and a bottoming cycle. The topping cycle is like that described above, except that the direct contact condenser is replaced by a bottoming trim heater, the flow from which is passed into a pump and thence returned for combining with the weak solvent solution withdrawn from the interchanger. Also, the source heat flows withdrawn from the topping regenerator and topping trim heater are combined and used as the bottoming source heat flow for passage into the bottoming regenerator. Such an alternative power generating cycle utilizes two different mixtures for forming the media, which may or may not contain common components. Some mixtures may have properties which permit direct contact heat transfer between the topping and bottoming cycles.

Advantages of the present invention include a power generating cycle configuration which permits an arbitrary extent of utilization of the thermal energy source and cold sink, limited only by equipment constraints and economics. Another advantage is the use of a solution and working fluid combination from which the working fluid boils over a range of temperatures and by direct contact condenses with the solution over a range temperatures. Such media permits the working fluid to more closely approach the temperature extremes of the heat source and the cold sink than is permitted utilizing a pure or azeotropic working fluid.

These and other advantages will be readily apparent to those skilled in the art based upon the disclosure contained herein.

These drawings will be described in detail in connection with the Detailed Description of the Invention which appears below.

DETAILED DESCRIPTION OF THE INVENTION

The power generating cycle of the present invention combines the benefits of the Rankine cycle with those of the absorption/refrigeration cycle, without necessarily being adversely affected by their drawbacks. Two concepts embodied in the power generating cycle which contribute to its success are the optimization of internal heat exchange and the exploitation of the heat source and cold sink. It is to be noted that both of these factors are applied simultaneously to the power generating cycle, rather than individually, resulting in substantial benefits to the overall process. Internal heat exchange alone may reduce the extent of exploitation of the heat source and/or cold sink. Conversely, complete use of the heat source and cold sink may result in an increase in equipment size, while only marginally increasing power output. Application of both concepts simultaneously, however, permits maximum power output with low investment required for equipment.

Figure 1:
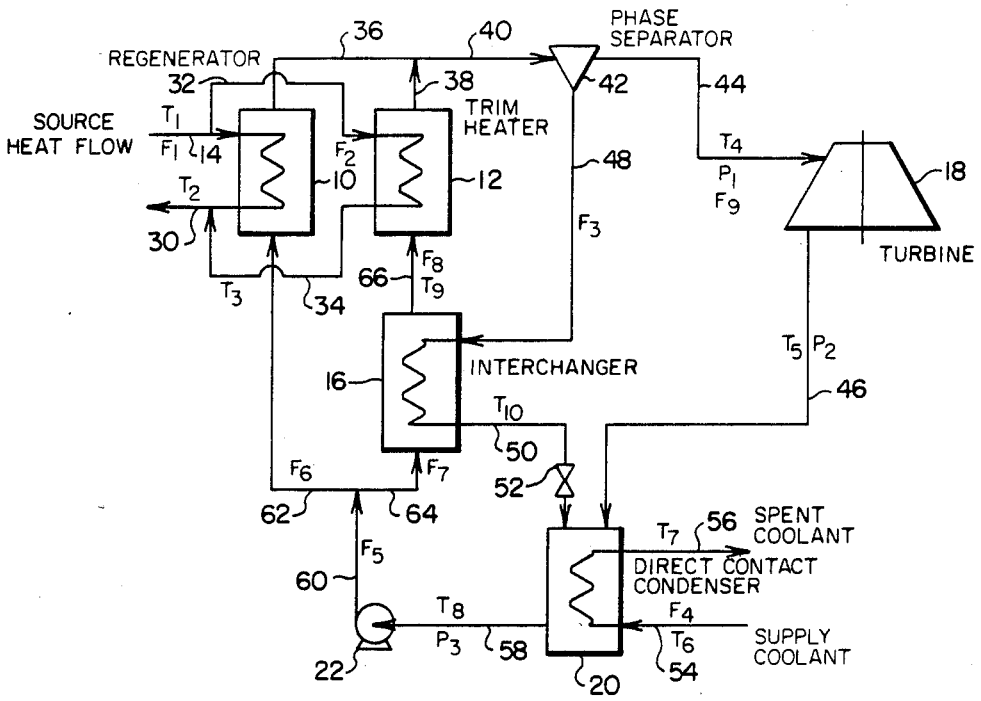
FIG. 1 is a schematic diagram of a specific configuration of the power generating cycle of the present invention.

Referring to FIG. 1, the power generating cycle is seen to utilize seven basic unit operations (which may be comprised of individual or multiple pieces of equipment optionally connected in series, parallel, or combinations thereof), viz. three counter-current heat exchangers, one pump, one phase separator, one direct contact condenser (or absorber), and one turbine. Two of the heat exchangers, regenerator 10 and trim heater 12, permit transfer of thermal energy from source heat flow 14 to a liquid media. The third heat exchanger, interchanger 16, reclaims some energy from the heated weak solution in order to heat a portion of the media circulating in the system. Thus, a primary function of these three heat exchangers is to vaporize the absorbed working fluid from the weak solution bearing same. Turbine 18 converts the transferred thermal energy into a useful form. Direct contact condenser 20 permits the spent vaporous working fluid to be condensed into a liquid by its absorption by the weak solvent solution. Finally, pump 22 passes the reconstituted media to the original three heat exchangers, i.e. through regenerator 10, trim heater 12, and interchanger 16.

Source heat flow 14 can be derived from a variety of sources including, for example, geothermal, solar, process streams, and the like. While such source heat flows may be at a premium temperature ranging on up to about 300° C. above ambient, the inventive power generating cycle can operate efficiently on source heat flow temperatures as low as about 10° C. above ambient. Source heat flow 14 enters at temperature $T_1$ and flow rate $F_1$ into regenerator 10 and is withdrawn via line 30 at temperature $T_2$. Regenerator 10 is a conventional counter-current heat exchanger which may be sized based upon economy of equipment costs at a given source heat flow rate and temperature $T_1$ and coolant temperature or based upon other desired criteria. The other stream passing through regenerator 10 will be described later in the description of the power cycle. A portion of source heat flow is passed via line 32 at flow rate $F_2$ into trim heater 12 and thence is withdrawn via line 34 at temperature $T_3$ for removal from the process along with spent source heat flow 30. Regenerator 10 absorbs the full range of heat available from source heat flow 14 while trim heater 12 absorbs the premium or high-end heat from source heat flow 14. Such dual parallel heat extraction configuration comprising regenerator 10 and trim heater 12 is an important aspect of the power generating cycle contributing to the overall efficiencies realized thereby.

The media of the power generating cycle comprises a solution bearing absorbed working fluid and such media is heated in regenerator 10 and trim heater 12. The working fluid is characterized by boiling from the solution over a range of temperatures and by direct contact condensing or absorption in the solution over a range of temperatures. Such characteristics contribute to improved heat exchange efficiency and/or greater exploitation of a given energy source. Further, because the vapor pressure of the solution over the boiling range of the working fluid is very low, e.g. essentially zero, only a portion of the media vaporizes. The remainder of the media, i.e. weak solution, is available for relatively efficient, liquid phase energy recovery followed by absorption of the expanded vapor later in the process. While the media may be composed of a plurality of ingredients, a simple binary pair of solvent and working fluid will contribute to ease in designing equipment for use with the power generating cycle of the present invention. Representative media include, for example, ammonia/water, ammonia/sodium thiocyanate, mercury/potassium, propane/toluene, and pentane/biphenyl and diphenyl oxide (Dowtherm A, Dow Chemical Co.).

Heated media from regenerator 10 is withdrawn via line 36 and combined with heated media 38 withdrawn from trim heater 12 and such combined heated media flow 40 passed into phase separator 42. Phase separator 42 is conventional in construction and permits the media to be split into distinct vapor (working fluid) and liquid (weak solution) phases. Separated vaporous working fluid is withdrawn from phase separator 42 via line 44 at temperature $T_4$ and pressure $P_1$ and thence passed into turbine 18 wherein the vaporous working fluid is expanded to a lower pressure $P_2$ and lower temperature $T_5$. Useful work is extracted from the vaporous working fluid via turbine 18. The expanded or spent vaporous working fluid is withdrawn from turbine 18 via line 46 and passed into direct contact condenser (absorber) 20.

Referring back to phase separator 42, heated liquid weak solvent solution is withdrawn from phase separator 42 via line 48 at flow rate $F_3$ and passed into interchanger 16. Interchanger 16 is a conventional counter-current heat exchanger, substantially like those heat exchangers comprising regenerator 10 and trim heater 12. Interchanger 16 functions as an internal transfer station for transferring heat from the separated heated weak solution to re-formed media which flows therethrough. The heat-transferred weak solution is withdrawn from interchanger 16 via line 50 and thence through optional flow control valve 52 and into direct contact condenser 20.

In direct contact condenser 20 the spent vaporous working fluid is absorbed by the weak solution for reconstituting or reforming the media. Direct contact condensing is characterized by a release of heat which is absorbed by supply coolant which flows via line 54 at temperature $T_6$ and flow rate $F_4$ into direct contact condenser 20 and is withdrawn via line 56 at temperature $T_7$. The coolant conveniently can be any readily available fluid, preferably liquid, such as water. Of course, the coolant temperature $T_6$ should be less than the source heat flow temperature $T_1$. The reconstituted media is withdrawn from direct contact condenser 20 via line 58 at temperature $T_8$ and pressure $P_3$. At this juncture of the process, the media is at a relatively low temperature and low pressure. Accordingly, the media in line 58 is passed into pump 22 which may be any suitable flow transport or fluid energy transport apparatus.

From pump 22, is withdrawn pressurized media via line 60 at flow rate $F_5$. Such pressurized media is split into flows 62 and 64 which have flow rates $F_6$ and $F_7$, respectively. The pressurized media in line 62 is passed into regenerator 10 while the pressurized media in line 64 is passed into interchanger 16 to complete the cycle.

Figure 2:
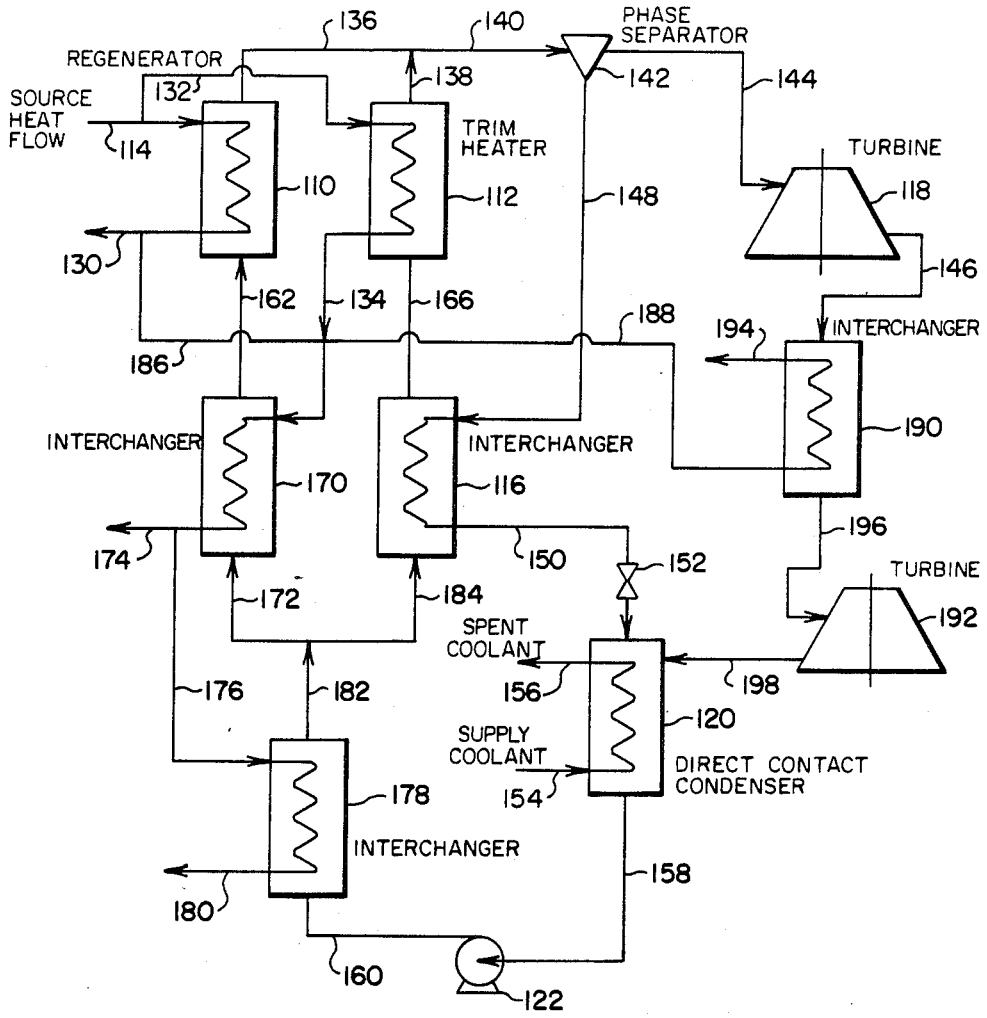
FIG. 2 is a schematic diagram of process alternatives which may be applied to the specific cycle configuration depicted in FIG. 1.

Depending upon the source heat flow temperature, $T_1$, some of the internal streams in the cycle may have sufficient heat value to warrant further internal heat transfer. In fact, provision for a multiple turbines may be practical. Some process alternatives which may be applied to the basic power generating cycle depicited in FIG. 1 are set forth in FIG. 2. In FIG. 2, it is assumed that the temperature of the source heat flow in line 134 is sufficiently high to warrant further internal heat exchange with it. Such internal heat exchange may be accomplished by passing source heat flow from trim heater 112 via line 134 into interchanger 170 which is a counter-current heat exchanger for transferring heat from source heat flow 134 with pressurized media in line 172. The heat-exchanged source heat flow is withdrawn from line 170 via line 174 and, if the temperature of such heat flow warrants, may be passed via line 176 into interchanger 178 which is a counter-current heat exchanger for further preheating pressurized media in the line 160 exiting pump 122. The heat-exchanger source heat flow is withdrawn from interchanger 178 via line 180. The heated media in interchanger 178 is withdrawn via line 182 which is split into two flows, one flow flowing in line 172 to interchanger 170 and the other flow flowing in line 184 to interchanger 116. It will be appreciated that the use of interchanger 170 and 178 are optional depending upon the particular conditions which exist in the cycle.

Alternative uses for the source heat flow in line 134 exiting trim heater 112 include passing such source heat flow via line 186 for removal from the process via line 130. Alternatively, the flow in line 134 may be passed via line 188 into interchanger 190 which serves as a preheater for turbine 192. The heat-exchanged source heat flow in interchanger 190 is withdrawn via line 194. The working fluid exhausted from turbine 118 is passed via line 146 into interchanger 190 whereat it is preheated by counter-current heat exchange relationship being established with the source heat flow in line 188. The thus-heated working vapor then is withdrawn from interchanger 190 via line 196 and passed into turbine 192. The working fluid exhausted from turbine 192 is withdrawn via line 198 and passed into direct contact condenser 120 which functions as described in FIG. 1. It will be appreciated that additional process alternatives may be implemented in the power generating cycle of the present invention provided that the precepts of the present invention are followed.

Figure 3:
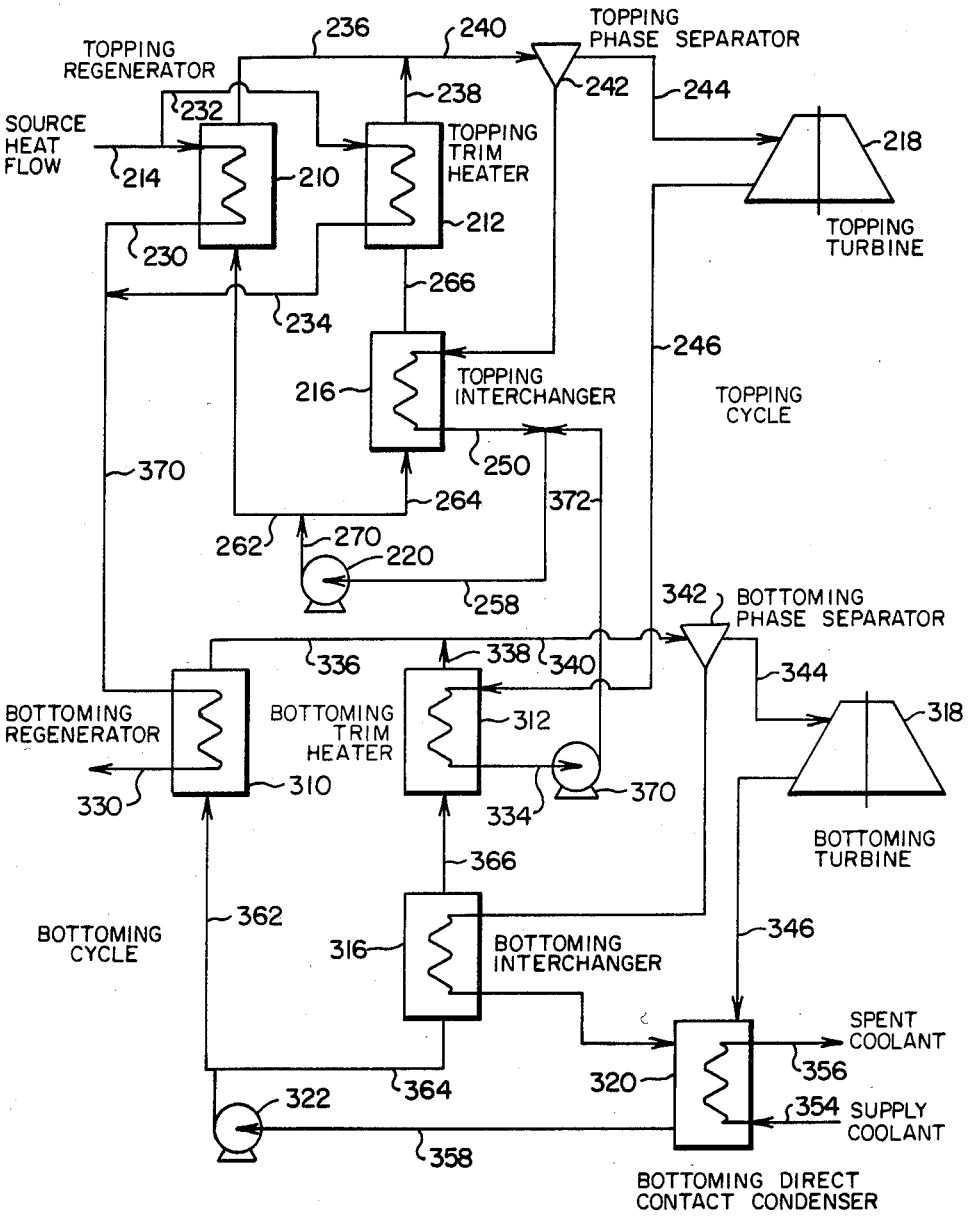
FIG. 3 is a schematic diagram of an alternate configuration of the power generating cycle wherein a higher temperature heat source is available.

The power generating cycles depicted in FIGS. 1 and 2 will operate efficiently and effectively on low and impedance grade heat sources. While such power generating cycle configurations also will operate on higher grade heat sources, the alternatives process flow configuration in FIG. 3 may dramatically affect efficiency of the exploitation of a higher grade source heat flow. The power generating cycle depicted in FIG. 3 is composed of a topping cycle and a bottoming cycle. The topping cycle extracts the premium (high-end) heat from source heat flow 214. The media utilized in the topping cycle is composed of a solution and a working fluid which exhibit the desired characteristics, e.g. boiling range of working fluid from solution, for the particular temperature of the source heat flow available. It is expected that a second, and different, media will be used in the bottoming cycle which media exhibits characteristics suitable for the temperature of the heat flow being admitted to such bottoming cycle. Of course, the topping media and the bottoming media may contain common components. Additionally, some mixtures may have properties which permit direct contact heat transfer between the topping and bottoming cycles. It will be appreciated that options may exist for direct contact heat transfer between the topping media and the bottoming media, depending upon compatibility. With respect to the cycle depicted in FIG. 3, the topping cycle consists of topping regenerator 210, topping trim heater 212, topping phase separator 242, topping interchanger 216, topping turbine 218, and topping pumps 220 and 222. The basic flow pattern and operation of the topping cycle is like that depicted for the cycle in FIG. 1 and the reference numbers correspond to the reference numbers in FIG. 1, but are of the 200 series in FIG. 3.

It will be noted that no direct contact condenser is contained in the topping cycle. Instead, the expanded working vapor from topping turbine 218 is withdrawn via line 246 and passed into bottoming trim heater 312 which is a counter-current heat exchanger which operates much like topping trim heater 212. The heat-exchanged working vapor is withdrawn from bottoming trim heater 312 via line 334 and passed into pump 370 for transport back to the topping cycle via line 372. The working vapor in line 372 is combined with the weak solvent solution in line 250 exiting topping interchanger 216 and the reconstituted media passed into pump 220 via line 258. The media is withdrawn from pump 220 via line 270 and split into two flows, one flow in line 264 being passed to topping interchanger 216 and the other flow in line 262 passing into topping regenerator 210.

The source heat flow in line 230 withdrawn from topping regenerator 210 and the source heat flow in line 234 withdrawn from topping trim heater 212 are combined into a single flow in line 370 and passed into bottoming regenerator 310. Bottoming regenerator 310 is a counter-current heat exchanger like topping regenerator 210. The heat-exchanged source heat flow is withdrawn from bottoming regenerator 310 via line 330 for withdrawal from the cycle. In bottoming regenerator 310, pressurized media in line 362 is heated by the source heat flow in line 370. The heated media is withdrawn via line 366 and combined with heated media in line 338 which is withdrawn from bottoming trim heater 312 and passed via line 340 into bottoming phase separator 342. The remainder of the bottoming cycle is identical to the cycle described in connection with FIG. 1 and the reference numerals are the same except they are of the 300 series. Typical source heat flow operating temperatures which are envisioned for the cycle depicted in FIG. 3 range from between about 200° and 2,000° C.

In order for a better understanding of the power generating cycle of the present invention to be gained, the following prophetic design example is given. This design example is for the power generating cycle described in connection with FIG. 1. Several assumptions were made to enable calculations on the cycle to be made. The stated information for the cycle included hot water as the source heat flow, cold water as the coolant, ammonia as the working fluid, and sodium thiocyanate as the less volatile component of the mixture. Thermophysical properties on the ammonia/sodium thiocyanate media were generated from data presented by Blytas and Daniels, *Journal of the American Chemical Society,* Vol. 84, No. 7, pp 1075–1083 (1962), and by Sargent and Beckman, *Solar Energy,* Vol. 12, pp 137–146 (1968), according to standard engineering principles. Close agreement with data presented by both of these articles was found. With respect to heat exchanger performance, an overall heat transfer coefficient of 250 BTU/hr ft$^2$ °F. was used for all heat exchangers. The temperatures, heat duties (Q) and required area of the heat exchanger then were calculated. Simplistic analysis was undertaken with respect to the vaporizers and direct contact condensers since the operation of such equipment is complex. A turbine efficiency of 80% and a transmission efficiency of 95% were assumed additionally. Parasitic losses for pumping were estimated and deducted.

Based upon the foregoing assumptions, the following information was derived for this prophetic design example.

DESIGN EXAMPLE

| Pressures (psia) | $P_1$ | $P_2$ | $P_3$ |
|---|---|---|---|
| | 463.24 | 180.0 | 178.52 |
| Temperatures | | °F. | °C. |
| Source Heat Flow | $T_1$ | 250.00 | 121.11 |
| Source-Regenerator Outlet | $T_2$ | 116.27 | 46.82 |

-continued

DESIGN EXAMPLE

| | | | |
|---|---|---|---|
| Source-Trim Heater Outlet | $T_3$ | 181.12 | 82.85 |
| Turbine Inlet | $T_4$ | 230.00 | 110.00 |
| Turbine Outlet | $T_5$ | 101.00 | 38.33 |
| Coolant Inlet | $T_6$ | 90.00 | 32.22 |
| Coolant Outlet | $T_7$ | 101.27 | 38.49 |
| Condenser Outlet | $T_8$ | 100.00 | 37.78 |
| Media-Trim Heater Inlet | $T_9$ | 166.12 | 74.51 |
| Solvent-Condenser Inlet | $T_{10}$ | 116.27 | 46.82 |

| Fluid Properties | Media-Line 60 | Weak Solution-Line 48 |
|---|---|---|
| $NH_3$ Mass Fraction | 0.800 | 0.500 |
| Specific Gravity | 0.694 | 0.896 |
| Heat Capacity (BTU/lb°F.) | | |
| Condenser 20 | 0.955 | 0.654 |
| Regenerator 10 | 1.270 | 1.065 |

| Cycle Streams Enthalpies | | (klb/hr) | (BTU/lb) | Flow Rate (BTU/lb) |
|---|---|---|---|---|
| Source-Regenerator | $F_1$ | 586.749 | 218.90 | 85.17 |
| Source-Trim Heater | $F_2$ | 1413.201 | 218.90 | 150.02 |
| Solvent-Interchanger Inlet | $F_3$ | 205.734 | 72.72 | −26.23 |
| Coolant Inlet | $F_4$ | 14,171.702 | 90.00 | 101.27 |
| Media-Pump Outlet | $F_5$ | 514.334 | 16.67 | 17.89 |
| Media-Regenerator Inlet | $F_6$ | 205.734 | 17.89 | 399.29 |
| Media-Interchanger Inlet | $F_7$ | 308.600 | 17.89 | 83.86 |
| Media-Trim Heater Inlet | $F_8$ | 308.600 | 83.86 | 399.29 |
| Working Vapor | $F_9$ | 308.600 | 617.00 | 563.00 |

| Equipment | Duty (kBTU/hr.) | Capacity (Ft.$^2$ or kw) |
|---|---|---|
| Regenerator 10 | 78,465.89 | 18,059 |
| Trim Heater 12 | 97,341.28 | 25,958 |
| Interchanger 16 | 20,357.56 | 2,414.0 |
| Turbine 18 | 16,664.42 | 4,640.60 |
| Condenser 20 | 159,769.41 | 51,825.0 |
| Pump 22 | 626.67 | 183.54 |
| Net Power Output | 4269.49 kW | |
| Net Power Efficiency | 0.083 | |

Note that the turbine duty represents the internal cycle condition. The corresponding capacity has been decremented by the transmission efficiency. Finally, the net power output has been decremented by the assumed parasitic pumping requirements of the cycle. The net efficiency is the net power output divided by the total power input to the cycle.

The above-tabulated predicted results clearly show the efficiency of the power generating cycle of the present invention.

I claim:

1. A method for generating energy from a source heat flow which comprises:

(a) passing heated media comprising a solution bearing absorbed working fluid into a phase separator, said media being at a temperature and pressure adequate for said fluid to be volatilized and separated from said in said phase separator, said working fluid characterized by boiling from said solution over a range of temperatures and by direct contact condensing in said solution over a range of temperatures, the vapor pressure of said solution over said boiling point range being negligible;

(b) withdrawing said vaporous working fluid from said separator and passing same into a work zone wherein said fluid is expanded to a lower pressure and temperature to release energy;

(c) withdrawing said expanded vaporous working fluid from said work zone and passing same into a direct contact condenser;

(d) withdrawing a weak solution from said phase separator and passing same into counter-current heat-exchange relationship in an interchanger with a portion of pressurized media from said direct contact condenser;

(e) passing said heat-exchanged weak solution from step (d) into said direct contact condenser and contacting same with said expanded vaporous working fluid for absorbing said working fluid into said weak solution for re-forming said media;

(f) passing a coolant flow into said direct contact condenser for absorbing heat from the contents therein;

(g) passing said re-formed media withdrawn from said direct contact condenser into a flow transport apparatus;

(h) passing a portion of said media from said flow transport apparatus into counter-current heat-exchange relationship in said interchanger with said separated weak solution in step (d);

(i) passing said portion of said heat-exchanged media from step (h) into counter-current heat-exchange relationship in a trim heater with a portion of said source heat flow;

(j) passing said remaining portion of said media from step (g) into counter-current heat-exchange relationship in a regenerator with the remaining portion of said source heat flow; and (k) combining said heated media flows from said regenerator and from said trim heater to form said heated media for step (a).

2. The method of claim 1 wherein said work zone in step (b) comprises a turbine or piston and cylinder.

3. The method of claim 1 wherein said source heat flow is at a temperature ranging from between about 10° and 300° C. above ambient.

4. The method of claim 1 wherein said coolant flow in step (f) comprises water or air which is at a temperature which is less than the temperature of said source heat flow.

5. The method of claim 1 wherein said media is selected from the group consisting of ammonia/water, ammonia/sodium thiocyanate, mercury/potassium, propane/toluene, and pentane/biphenyl and diphenyl oxide.

6. The method of claim 2 wherein said work zone of step (b) comprises multiple turbines in series.

7. The method of claim 6 wherein the vaporous working fluid between said turbines is heated.

8. The method of claim 7 wherein said vaporous working fluid between said turbines is heated by the spent source heat flow from said trim heater.

9. The method of claim 1 wherein the reformed media from step (g) is heated with spent source heat flow from said trim heater prior to step (h).

10. A method for generating energy from a source heat flow which comprises:

(a) passing a heated topping media comprising a topping solution bearing absorbed topping working fluid into a topping phase separator, said topping media being at a temperature and pressure adequate for said topping fluid to be volatilized and separated from said topping solution in said topping phase separator, said topping working fluid characterized by boiling from said topping solution over a range of temperatures and by direct contact condensing in said topping solution over a range of temperatures, the vapor pressure of said topping solution over said boiling point range being negligible;

(b) withdrawing said vaporous topping working fluid from said topping phase separator and passing same into a topping work zone wherein said topping fluid is expanded to a lower pressure and temperature to release energy;

(c) withdrawing said expanded vaporous topping working fluid from said topping work zone and passing same into a bottoming trim heater;

(d) withdrawing a topping weak solution from said topping phase separator and passing same into counter-current heat-exchange relationship in a topping interchanger with a portion of pressurized topping media from said bottoming trim heater;

(e) combining said heat-exchanged topping weak solution from said topping interchanger and said heat-exchanged topping working fluid from said bottoming trim heater and passing the thus-formed topping media into a topping flow transport apparatus;

(f) passing a portion of said topping media from said topping flow transport apparatus into counter-current heat exchange relationship in said topping interchanger with said separated topping weak solution from said topping phase separator;

(g) passing said portion of said heat exchanged topping media from said topping interchanger into counter-current heat exchange relationship in a topping trim heater with a portion of said source heat flow;

(h) passing said remaining portion of said topping media from said topping flow transport apparatus into counter-current heat exchange relationship in a topping regenerator with the remaining portion of said source heat flow;

(i) combining said heated topping media flows from said topping regenerator and from said topping trim heater to form said heated topping media for step (a);

(j) passing a heated bottoming media comprising a bottoming solution bearing absorbed bottoming working fluid into a bottoming phase separator, said bottoming media being at a temperature and pressure adequate for said bottoming fluid to be volatilized and separated from said bottoming solution in said bottoming phase separator, said bottoming work fluid characterized by boiling from said bottoming solution over a range of temperatures and by direct contact condensing in said bottoming solution over a range of temperatures, the vapor pressure of said bottoming solution over said boiling point range being negligible;

(k) withdrawing said vaporous bottoming working fluid from said bottoming separator and passing same to a bottoming work zone wherein said bottoming fluid is expanded to a lower pressure and temperature to release energy;

(1) withdrawing said expanded bottoming vaporous working fluid from said bottoming work zone and passing same into a bottoming directcontact condenser;

(m) withdrawing a bottoming weak solution from said bottoming phase separator and passing same into counter-current heat exchange relationship in a bottoming interchanger with a portion of bottoming pressurized media from said bottoming direct contact condenser;

(n) passing said heat exchanged bottoming weak solution from step (m) into said bottoming direct contact condenser and contacting same with said expanded bottoming vaporous working fluid for absorbing said bottoming working fluid into said bottoming weak solution for reforming said bottoming media;

(o) passing a coolant flow into said bottoming direct contact condenser for absorbing heat from the contents therein;

(p) passing said reformed bottoming media withdrawn from said bottoming direct contact condenser into a bottoming flow transport apparatus;

(g) passing a portion of said bottoming media from said bottoming flow transport apparatus, the counter-current heat exchange relationship in said bottoming interchanger with said separated bottoming weak solution in step (m);

(r) passing said portion of said heat exchanged bottoming media from step (q) into counter-current heat exchange relationship in said bottoming trim heater with expanded topping vaporous working fluid from said topping work zone;

(s) passing said remaining portion of said bottoming media from step (p) in a counter-current heat exchange relationship in a bottoming regenerator with the spent source heat flow from said topping regenerator and topping trim heater; and (t) combining said heated bottoming media flows from said bottoming regenerator and from said bottoming trim heater to form said heated bottoming media for step (j).

11. The method of claim 10 wherein said topping work zone, said bottoming work zone, or both said topping and bottoming work zones comprise turbines or piston and cylinder combination.

12. The method of claim 10 wherein said source heat flow ranges in temperature from between about 200° and 2,000° C.

13. The method of claim 10 wherein said coolant comprises water or air which is at a temperature which is less than the temperature of said source heat flow.

14. The method of claim 10 wherein said topping media and said bottoming media independently are selected from the group consisting of ammonia/water, ammonium/thiocyanate, mercury/potassium, propane/toluene, and pentane/biphenyl and diphenyl oxide.

15. The method of claim 14 wherein said topping media and said bottoming media are different.

16. The method of claim 11 wherein said topping work zone comprises multiple turbines in series, said bottoming work zone comprises multiple turbines in series, or both said zones comprise multiple turbines in series.

17. The method of claim 16 wherein said topping vapor between said multiple turbines is heated, said bottoming vapor between said multiple turbines is heated, or both said vapors between said turbines are heated.

* * * * *